United States Patent [19]

Rourat et al.

[11] 4,100,665

[45] Jul. 18, 1978

[54] MACHINE FOR SEPARATING ROLLS OF CLOTH FROM THE SHAFTS ON WHICH THEY ARE ROLLED

[76] Inventors: Jean Rourat, Chemin de la Fouillouse, Riorges (Loire); Marcel Rourat, 65 Rue Lucien Sampaix, Roanne (Loire), both of France

[21] Appl. No.: 713,959

[22] Filed: Aug. 12, 1976

[30] Foreign Application Priority Data

Aug. 12, 1975 [FR] France ..... 75 25592

[51] Int. Cl.[2] ..... B23P 19/04

[52] U.S. Cl. ..... 29/252; 242/55.1; 242/81

[58] Field of Search ..... 29/234, 252; 254/148, 254/172, 189; 242/81, 55.1

[56] References Cited

U.S. PATENT DOCUMENTS

| | | | |
|---|---|---|---|
| 469,368 | 2/1892 | Bell et al. | 254/189 |
| 2,736,507 | 2/1956 | Neese et al. | 29/234 X |

FOREIGN PATENT DOCUMENTS

| | | | |
|---|---|---|---|
| 766,528 | 4/1934 | France | 254/189 R |

*Primary Examiner*—James L. Jones, Jr.
*Attorney, Agent, or Firm*—Remy J. VanOphem

[57] ABSTRACT

The present invention relates to a machine for extracting the metal shaft of a roll of knitted or woven textile cloth. The roll is mounted on a frame structure against a fixed stop. A traction cable is guided by a series of pulleys and on one end utilizes a harness to attach the cable to the shaft. At the opposite end of the cable, a tensioning means keeps the cable and tension during its operational load. Actuating device is attached to a pulley communicating with the traction cable to provide the necessary power to extract the shaft from the roll of textile cloth.

15 Claims, 23 Drawing Figures

MACHINE FOR SEPARATING ROLLS OF CLOTH FROM THE SHAFTS ON WHICH THEY ARE ROLLED

BACKGROUND OF THE INVENTION

The present invention concerns a device for withdrawing the shafts on which textile pieces have been rolled during their weaving or knitting.

The pieces finally obtained from a weaving or knitting machine are rolled on a shaft. When the roll of textile obtained reaches a sufficiently large dimension, the amount carried by the metal shaft around which the piece of cloth is rolled is taken from the machine. It is then necessary to extract the metal shaft to re-mount it on the machine. Generally this operation is manual. The extraction of the shaft is particularly delicate when it is a question of a knitted piece, for, in effect, this is made up of deformable stitches which strongly grip the shaft upon which it is rolled. Moreover, the fibres which make up a knitted piece slide badly. Thus, when an operator applies a longitudinal force to extract the shaft, the latter only comes out with great difficulty, whilst the roll of cloth held by a second operator is deformed.

The present invention has the aim of avoiding these disadvantages, and of creating a simple device for mechanisin the extraction of the roller shafts from woven or knitted textile pieces.

SUMMARY OF THE INVENTION

A machine according to the invention is characterized in that it comprises stops attached to the fixed frame, a traction cable of constant length, fitted at one of its ends with a harness able to be firmly attached to the shaft, whilst a pneumatic circuit feeds at least one double-action jack, of which the movement controls the displacement of the traction cable, of which the path is defined by return pulleys, means being provided to position the roll against the stops, so that traction on the cable is ensured by the re-entry of the stem of the jack and causes the extraction of the shaft attached to the harness, the roll of cloth being held motionless against the stops, whilst finally a system is provided so that the cable remains constantly taut during this operation.

According to another characteristic, the harness fitted to one end of the cable includes a yoke capable of fitting around one of the ends of the shaft which projects on each side from the roll of cloth, whilst the attachment of the yoke to the shaft is carried out by engaging a peg in radial openings drilled respectively in the yoke and in the shaft.

The shaft to be withdrawn may for example be tubular.

According to another characteristic, the stem of the double-action jack carries at its free end a pulley situated on the path of the extraction cable between a fixed return pulley and the free end which is immobilized during extraction, so that the movement of the piston carries with it the pulley and modifies the path of the cable which is of constant length, so that the position of the pulley determines that of the extraction harness.

According to a first manufacturing method a machine known as the horizontal model is fitted with stops arranged in a vertical plane and fixed to a horizontal table. One of the ends of the cable is attached to the harness, the opposite end being fixed to a counterweight. The tension system of the cable comprises the counterweight which slides or travels along a ramp inclined to the horizontal, fitted at its upper end with a stop to immobilize the counterweight, hence the corresponding end of the cable. The mechanism includes finally a double-action jack arranged horizontally under the table in such a way that the pulley attached to the stem acts on the cable at a point situated between two return pulleys rotating about fixed axes. The first pulley is, for example, mounted at the end of the table on which the roll of cloth is positioned, whilst the second pulley is mounted at the upper end of the inclined ramp. In this construction, the axis of the roll of cloth, the axis of the pneumatic jack, the inclined ramp, the return pulleys and the path of the cable are situated in the same vertical longitudinal plane.

Following another manufacturing method a machine known as the vertical model comprises a pneumatic positioning system to bring the roll to bear against the lower face of horizontal stops attached to a vertical support. One end of the traction cable is anchored to the frame. This cable then passes over the pulley attached to the double-action jack positioned vertically, then around at least one return pulley carried by the upper part of the frame, whilst the harness fitted to the other end of the cable constitutes, by the simple effect of gravity, the cable tensioning device.

Following another characteristic, the pneumatic circuit of the vertical machine is fitted with limit contacters operated respectively by the pneumatic means utilised to apply the roll against the stops and by the stem of the jack when the extraction of the shaft is completed.

It hence suffices to vary, by the aid of a pneumatic jack, the path of a constant-length cable to extract the shaft on which cloth is rolled, the roll of textile being held bearing over all its transverse surface against the fixed stops between which is provided a space sufficient to allow the passage of the shaft to be withdrawn.

The attached drawings, given by way of non-limiting example, will allow the characteristics of the invention to be better understood:

DESCRIPTION OF THE PREFERRED EMBODIMENTS

Figure 1:
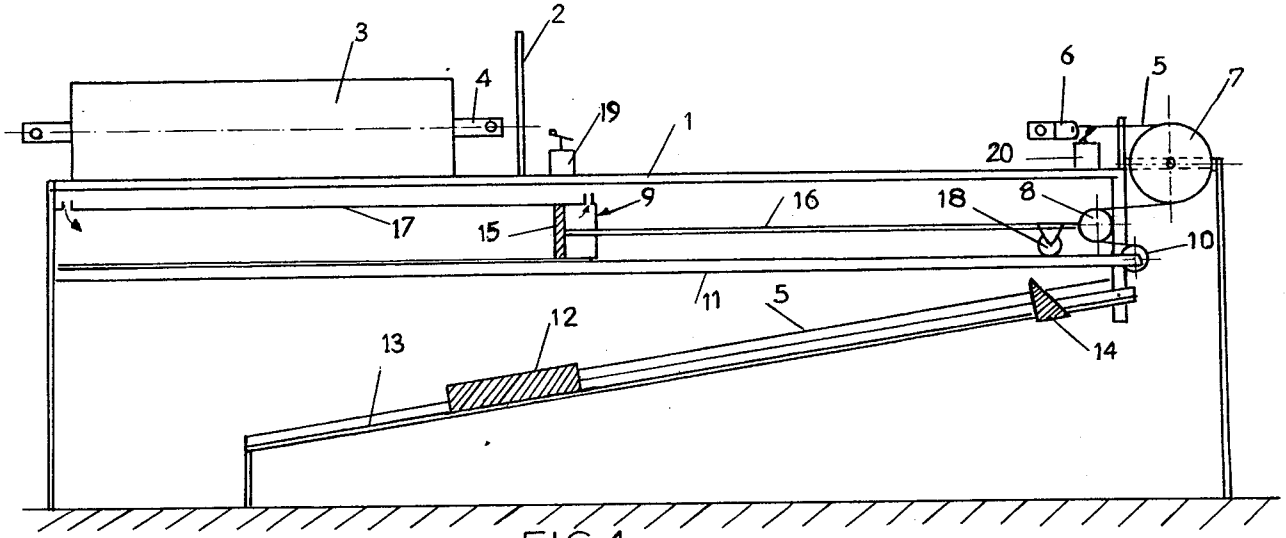
FIG. 1 is a general view of a machine according to the invention for drawing the shafts from rolls of cloth.

There is shown in FIG. 1 a machine according to the invention of the horizontal model. It comprises an upper plate or table 1 to which the stops 2 are fixed. It is a matter of separating the roll of cloth 3 from the shaft 4 on which it is rolled. For this a cable 5 is used, one end of it being fitted with a harness 6. This cable then passes over a first return pulley 7, over a pulley 8 fixed to the end of the stem of a pneumatic jack 9 and over a second return pulley 10 carried by the end of a lower plate 11 on which is mounted the body of the jack 9. Finally the other end of the cable 5 is anchored to a component 12 which slides along an inclined ramp 13. The weight of the component 12 keeps the cable 5 taut. The upper part of the ramp 13 is fitted with a stop system 14 able to block the counterweight 12.

The jack 9 is a double-action pneumatic jack, each of the two chambers of the cylinder 17 being able to be either fed by compressed air or open to the exhaust. According to the distribution of the air the piston 15 moves, carrying with it the stem 16 and the pulley 8, modifying the path of the cable between the return pulleys 7 and 10. The jack 9 is mounted on the horizontal plate 11 which constitutes a runway for a casterwheel 18 fixed near to the end of the stem 16.

Figure 2:
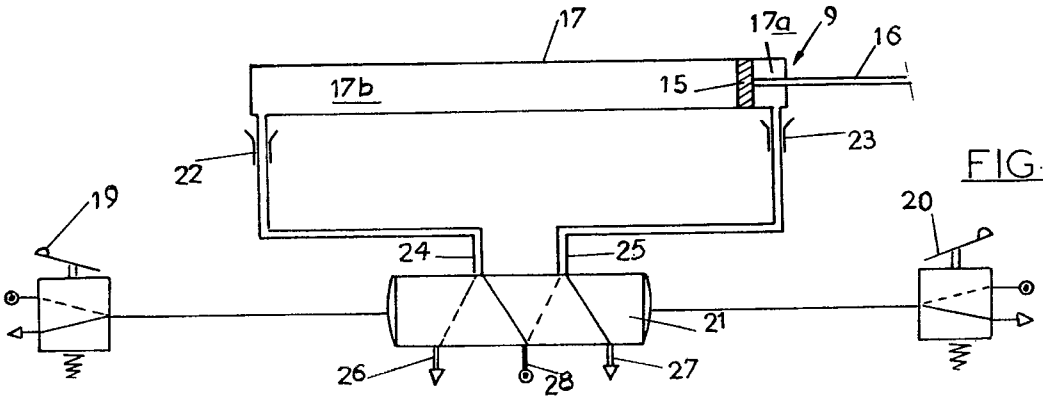
FIG. 2 represents the pneumatic control circuit of the double-action jack for a horizontal machine.
Figure 3:
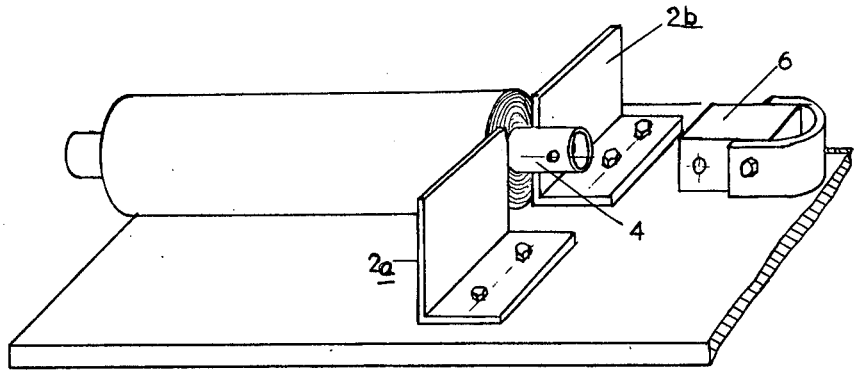
FIG. 3 is a view in perspective at the level of the bearing stops of the horizontal table.

The pneumatic circuit is illustrated in FIG. 2. The circuit is controlled from two push-buttons 19 and 20 fixed to the table 1 and positioned respectively near to the support stops 2 and near to the end of the table and the return pulley 7 (FIG. 1). This pneumatic circuit comprises a distributor 21 which swings according to the action of the pneumatic signal sent by the operation of one of the buttons 19 or 20. Each distributor includes two outputs, each linked to one of the chambers of the jack 9 through output limiters 22 and 23. Each of these outlets 24 and 25 can communicate either with an exhaust opening 26 or 27 or with the pressure feed 28. The chamber fed under pressure is determined by the operation on the buttons 19 and 20 which allow the sending of a pneumatic signal causing the distributor 21 to swing (FIG. 2). Referring to FIG. 3, the stops 2 are constituted for example by two L-shaped brackets 2*a* and 2*b*. These two brackets are fixed to the table 1 so that their vertical arms lie in the same transverse plane. They are separated from each other by a distance which allows the engagement between them of the shaft 4, whilst the roll 3 comes to bear against the brackets. It is known that the shaft 4 projects at each end from the roll of cloth 3. This shaft is for example tubular and drilled, near to its end, with two openings diametrically opposite. The table 1 carries, near to the stops 2, one of the control buttons 19 of the pneumatic circuit (FIG. 1).

Figure 4:
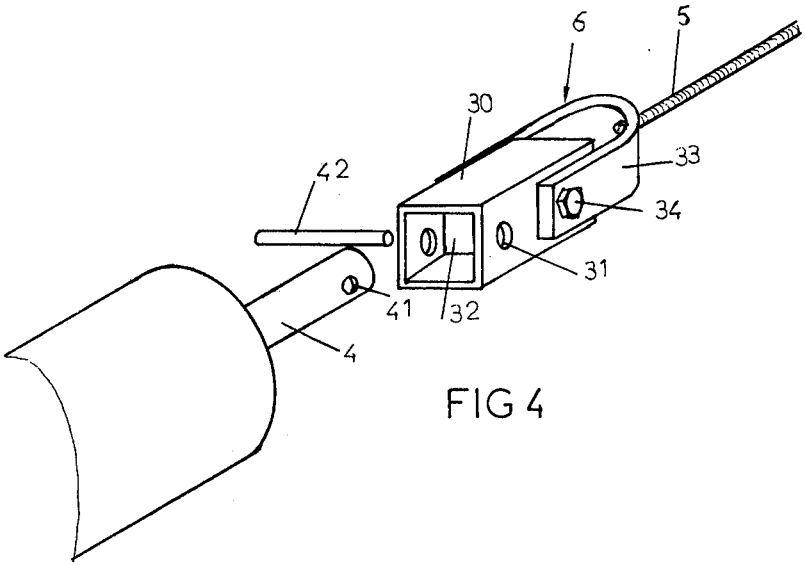
FIG. 4 is an exploded view of the pegging system between the traction harness and the end of the shaft.
Figure 5:
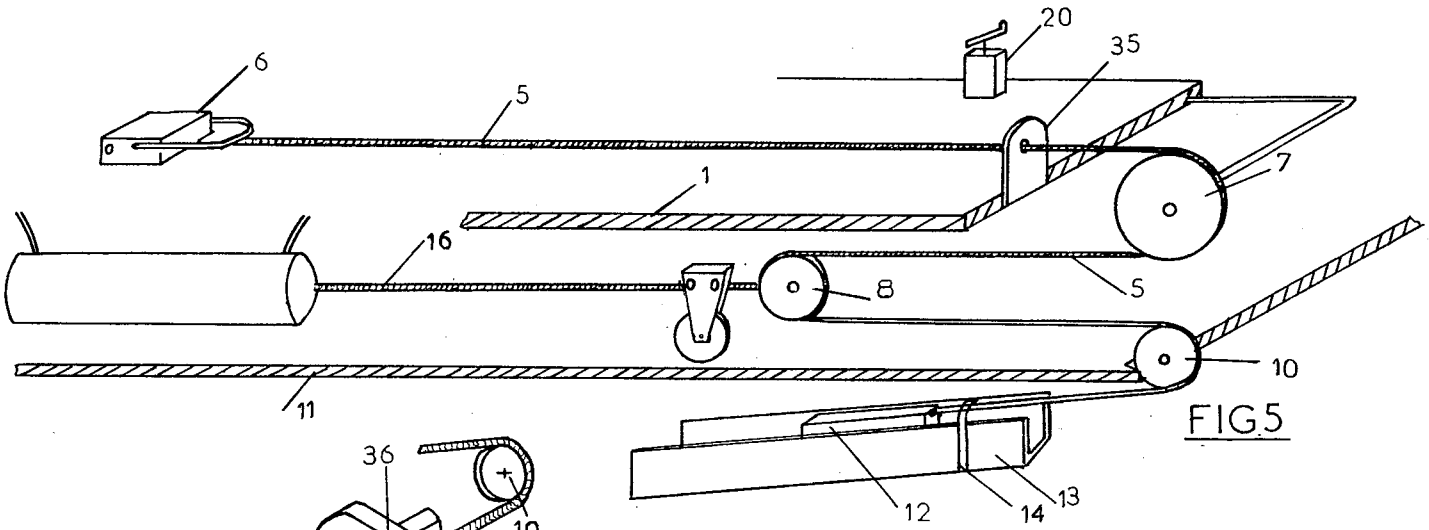
FIG. 5 is a view illustrating in particular the path of the traction cable.
Figure 6:
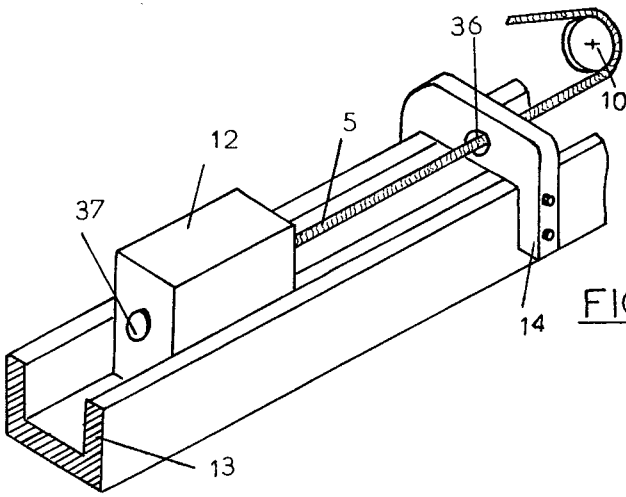
FIG. 6 is a view of the system for tensioning the traction cable.

FIG. 4 illustrates the harness attached to one end of the cable 5. A yoke 33 pivots about a retainer pin 34 carried by a rectangular tube member 30. The tube member further has two opposed mounting holes 31 through which is mounted a retainer peg or dowel 42 which is used to mount the tube 30 to the shaft 4 upon which the cloth is rolled. For this purpose, a hole 41 is provided in the end of the shaft. Locating the end of the shaft 4 with respect to the tube member 30 is provided by the stop plate 32. The cable 5 is attached to the closed end of the yoke 6. FIGS. 5 and 6 illustrate the traction cable path.

From the harness 6, the cable 5 passes successively through a stop and support 35, around the return pulley 7, mounted free to rotate about its transverse horizontal axis, around the pulley 8 carried by a yoke fitted to the free end of the stem 16, around a second return pulley 10 fitted at the rear end of the lower plate 11 and finally through an opening in the stirrup type stop device 14. The second end of the cable 5 is attached to the component 12 which slides along the inclined ramp 13 (FIG. 5). The stop device 14 is for example constituted by a saddle fixed to the lateral walls of the ramp 13 with U section. The center of the transverse part of this saddle is drilled with an opening 36 through which passes the cable 5, the end of which is firmly attached to the component 12. The U ramp 13 serves as a slideway and a means of guiding for this component 12 of which the extreme positions are defined by the stirrup 14 and the free length of the cable when the harness 6 butts against the stop 35. (FIGS. 5 and 6).

Naturally, the construction shown in the figures is given only as an example. The scope of the invention will not be exceeded by modifying details of manufacture.

OPERATION

The operation is as follows:

At rest, the stem 16 of the jack 9 is extended. The run of the cable between the pulleys 7 and 10 is at its mimimum. The weight of the component 12 draws down the rear end of the cable towards the lowest part of the inclined ramp until the harness 6 butts against the support 35. A roll 3 is placed on the table 1 in front of the stops 2 and it is slid so that the shaft 4 enters between the vertical plates 2*a* and 2*b* (FIGS. 1 and 3). The jack 9 is in the position shown in FIG. 2. The rear chamber 17*a* is connected to the exhaust, whilst the front chamber 17*b* is in communication with the compressed air supply. The rockers controlled by the buttons 19 and 20 are both in the exhaust position, so that no signal is being sent to the distributor 21.

Figure 7:
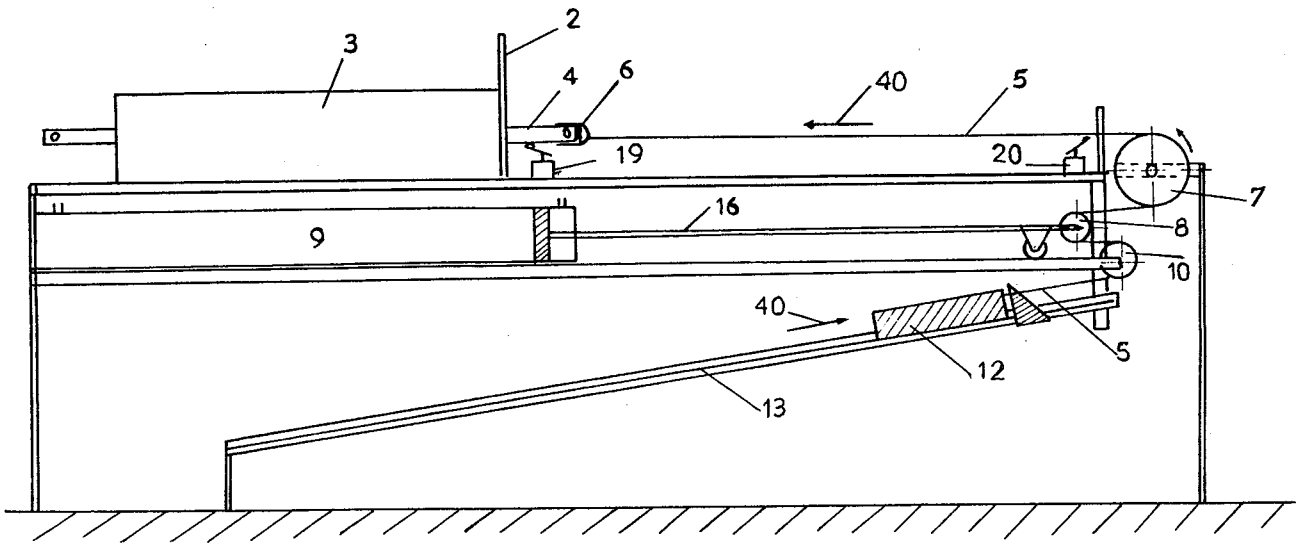
FIG. 7 illustrates the attachment of the cable to the shaft to be withdrawn.

The first operation is manual as illustrated in FIG. 7. It consists of attaching the harness 6 to the shaft to be withdrawn 4. For this, the harness is pulled according to the arrow 40. The cable 5 passes around the pulleys 7, 8 and 10. The counterweight 12 remounts the inclined ramp 13 and keeps the cable taut. The tube 30 of the harness 6 is engaged on the end of the shaft 4. The stop plate 32 facilitates the positioning of the openings 31 in the tube 30 opposite the opening 41 of the shaft 4. A peg or dowel 42 is then engaged in these openings to attach the shaft 4 and the cable 5 (FIG. 4). During this manual operation, the stem 16 of the pneumatic jack remains stationary (FIG. 7).

Figure 8:
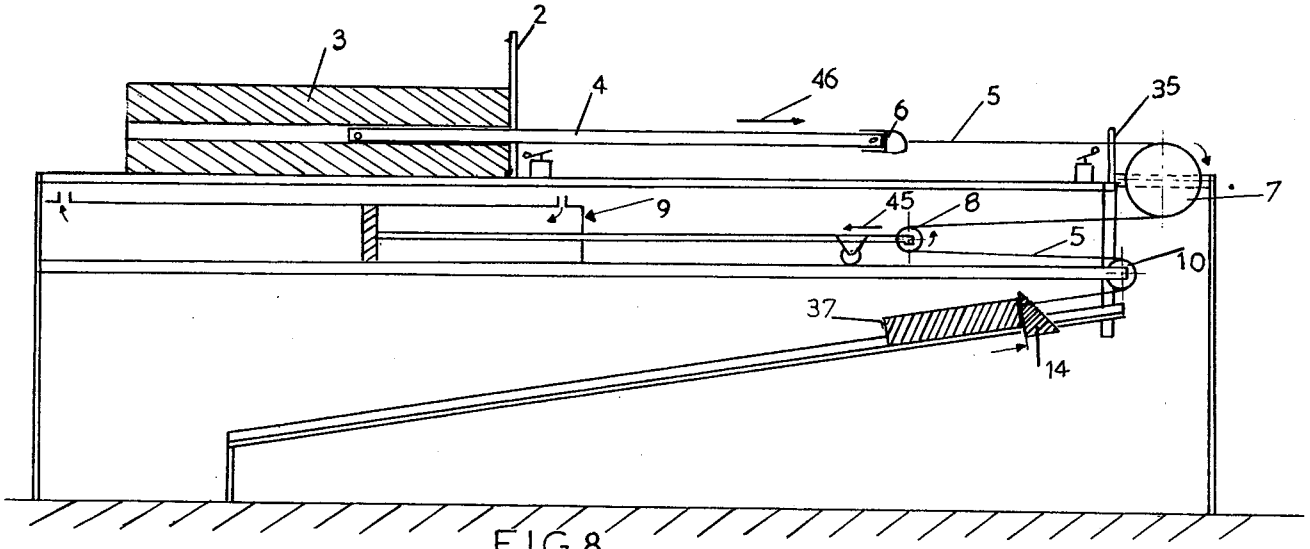
FIGS. 8 to 11 show the successive phases of operation and the position of the pneumatic control components for the corresponding stages.
Figure 9:
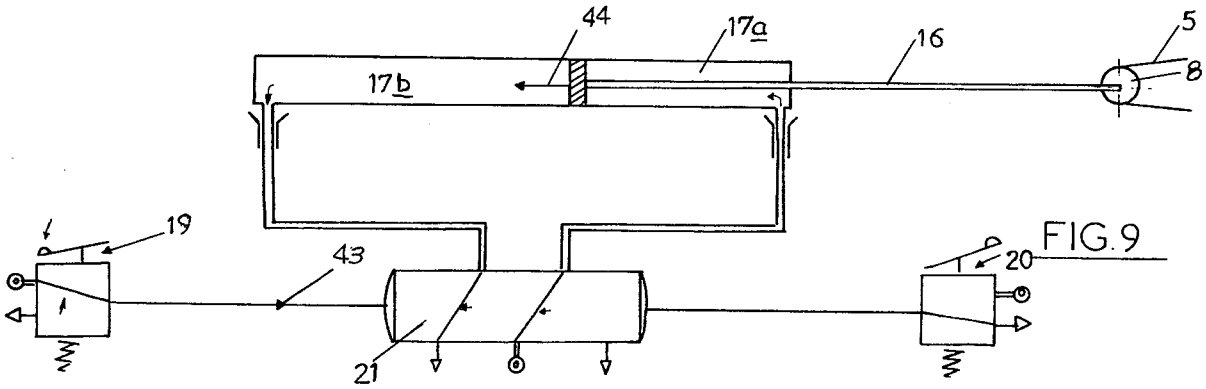

FIGS. 8 and 9 show the second phase of operation. The button 19, situated near to the stops 2, is pressed. The corresponding rocker sends a signal 43 to the distributor 21 of which the valves are displaced so as to put the chamber 17*b* in connection with the exhaust and to supply the chamber 17*a* of the jack 9. The resultant thrust 44 causes the stem 16 of the jack to be drawn into the distributor (arrow 45). The longitudinal displacement of the pulley 8 modifies the run of the cable 5, which has the following effect:

first, of applying the counterweight 12 against the stirrup 14, so that then the end 37 of the cable 5 is stationary; and second, to increase the length of cable between the pulleys 7 and 10, this lengthening being compensated by a reduction of the length between the support 35 and the harness 6.

Thus, during the re-entry of stem 16 into jack 9, the shaft 4 is drawn towards the right (arrow 46) whilst the piece of rolled cloth is held by the stops 2 (FIG. 8).

Figure 10:
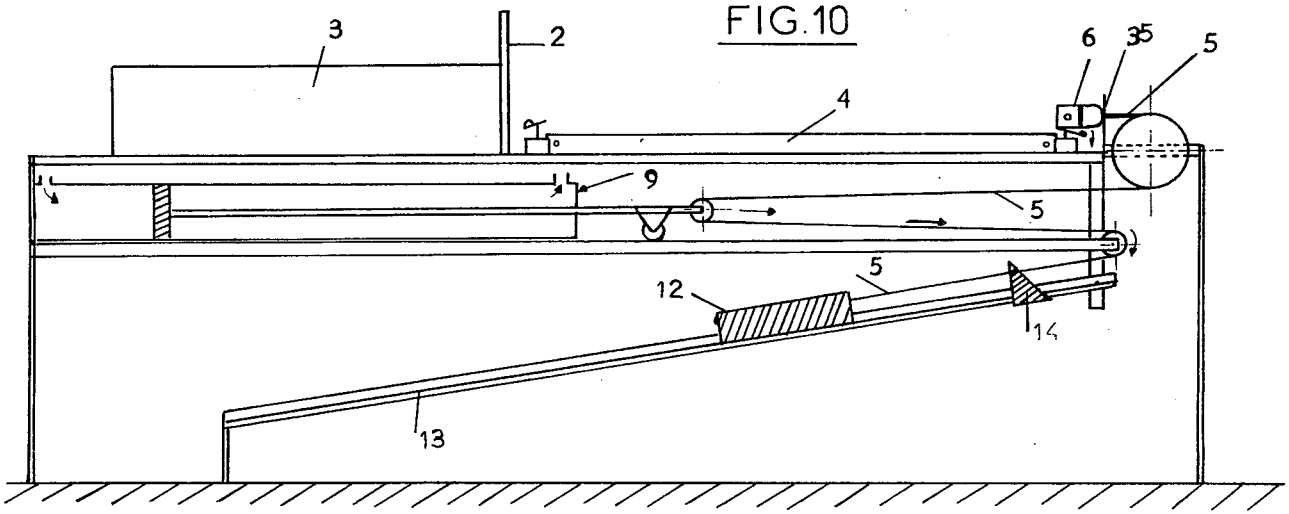
Figure 11:
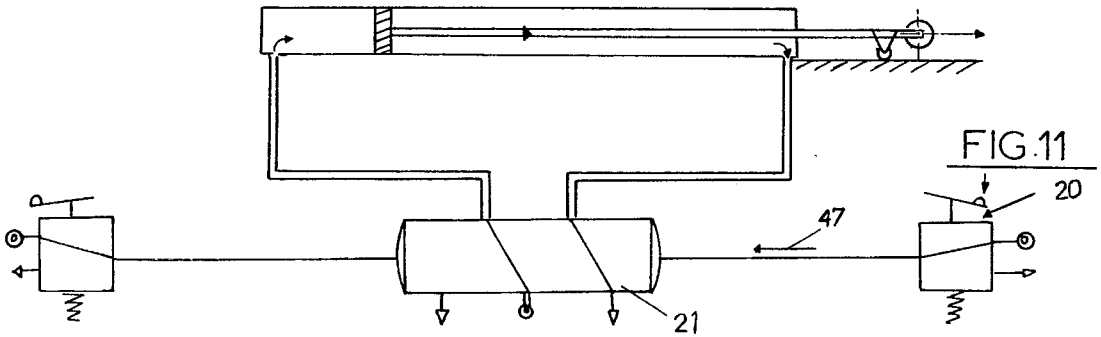
Figure 12:
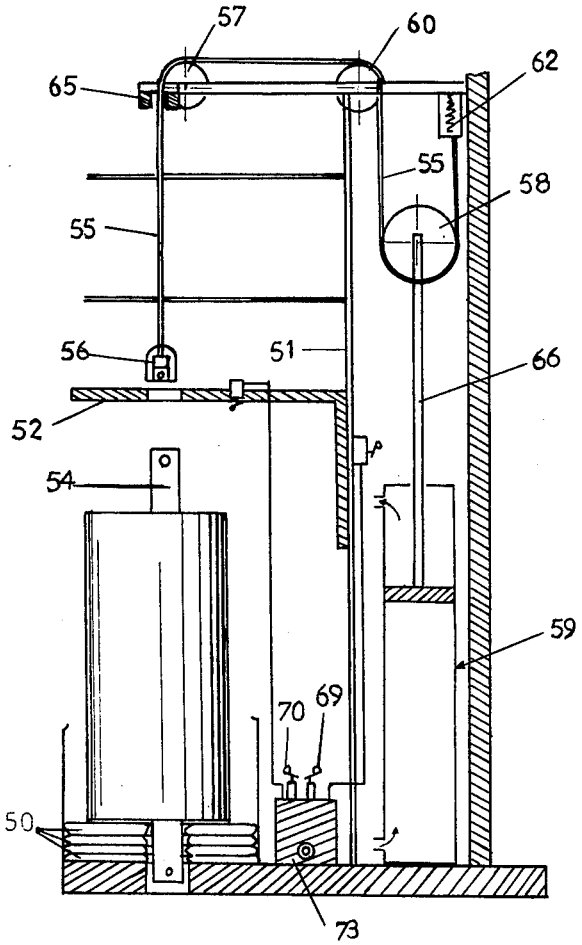
FIG. 12 is a view of an extraction machine operating vertically.

FIGS. 10 and 11 illustrate the final phase of operation. When the harness 6 comes to bear against the support 35, the shaft 4 is completely withdrawn from the roll 3. The dowel 42 is then taken out to uncouple the shaft from the harness and the button 20 situated near the stop support 35 is pressed. This button controls the corresponding rocker which sends a signal 47 to the distributor 21. The valves of this distributor swing to put the chamber 17*a* in connection with the exhaust and the chamber 17*b* with the compressed air supply (FIG. 12). The extension of the stem 16 causes the displacement of the pulley 8 according to the arrow 48. The harness 6 is held by the support 35 so that the counterweight 12 is released from the saddle 14 and slides along the ramp 13 keeping the cable 5 taut (FIG. 11). The rest position is thus regained; the jack stem extended as shown in FIG. 1.

During these re-entry and extension movements of the jack 9, the stem 16 is supported by a castor-wheel 18 running along the plate 16 which carries the jack 9 positioned longitudinally.

There is shown in FIG. 12 a machine according to the invention working in a vertical position. The roll of cloth 3 is placed vertically on an inflatable cushion 50, the stops 52 are fixed to a vertical support 51. The cable 55 carries a harness 56 capable of being pegged to the shaft 54 to be extracted. The extraction cable passes successively around guide pulleys 57 and 60, attached to the upper support plate 65, and around a pulley 58 moving with the stem 66 of the jack 59 arranged vertically. The other end of the cable 55 is connected to the upper part of the frame by a tensioning device 62 of any known type. Finally this vertically operating machine is fitted with a pneumatic circuit 73 set out in detail in FIG. 13 and controlled from two buttons 69 and 70. FIG. 12 corresponds to the rest position of the machine. The stem of the jack is extended and the cushion on which the roll of cloth rests is deflated.

Figure 13:
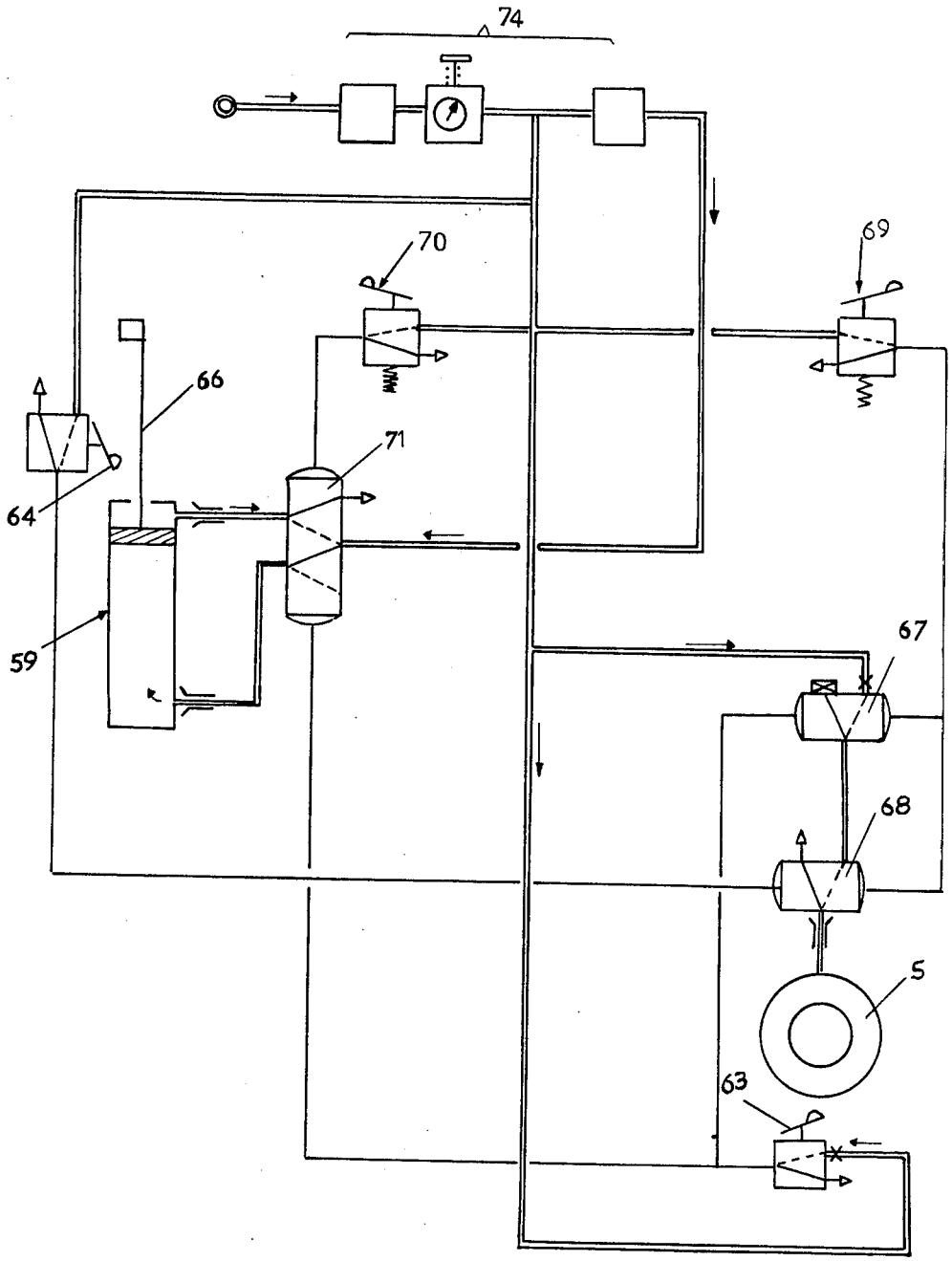
FIG. 13 is the pneumatic control diagram for the machine in FIG. 12, FIGS. 14, 16, 19 and 21 show the operation of the pneumatic circuit with an inflatable cushion, FIGS. 15, 17, 18 and 20 correspond respectively to the stages shown in FIGS. 14, 16, 19 and 21. They show the operation of the vertical machine during one cycle of the withdrawal of the shaft from a roll of cloth.
Figure 15:
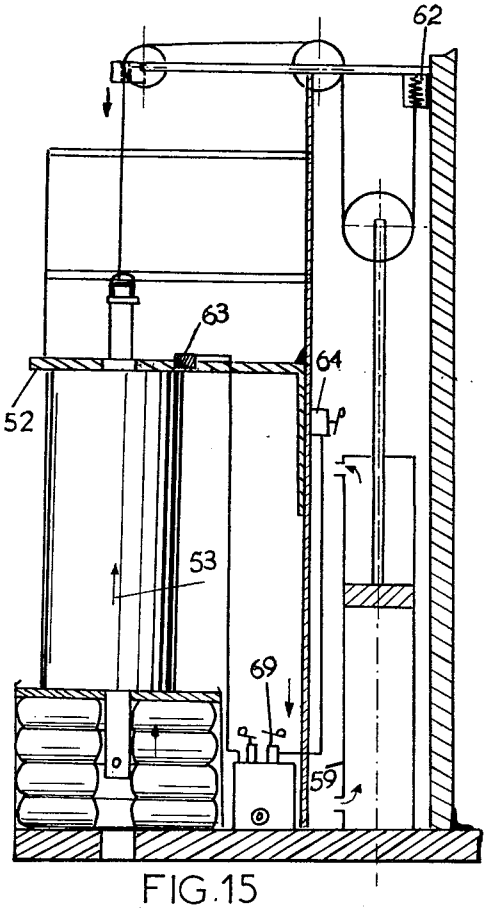
Figure 14:
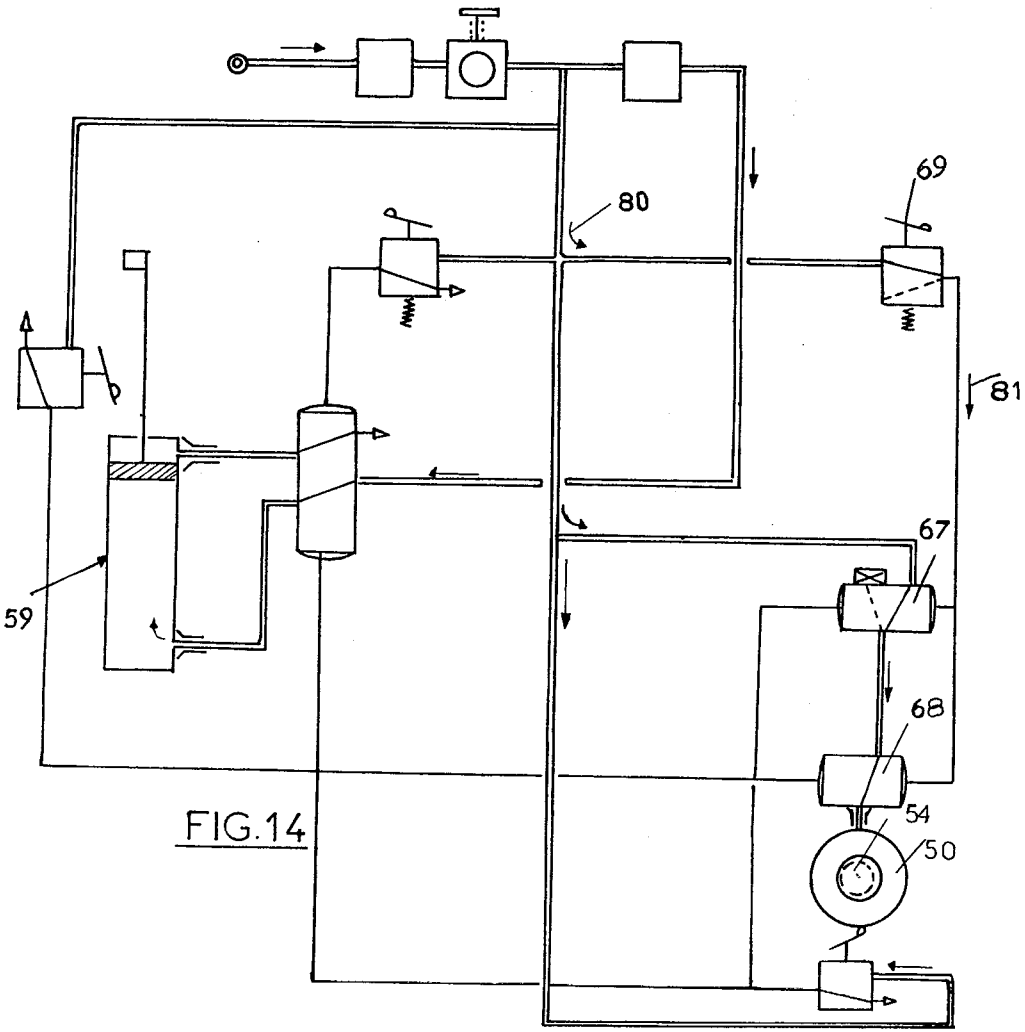

The rest position is obtained when the components of the pneumatic circuit are in the position shown in FIG. 13. The buttons 69 and 70 prevent the passage of compressed air which circulates only through a conditioning system 74 comprising for example a filter, a pressure reducing valve and a lubricator, to feed the distributor 71 from which the movements of re-entry and extension of the jack 59 are controlled. In the position of FIG. 13 it is seen that the distributors 67 and 68 are not supplied, so that the cushion 50 remains deflated. The control circuit in addition comprises limit rockers 63 and 64 controlled respectively by the inflation of the cushion 50 and the re-entry of the stem 66.

first phase of operation is illustrated in FIGS. 12, 14, and 15.

With the machine at rest the roll 3 is placed on the deflated cushion 50 (FIG. 12). Then a button 69 (FIG. 14) is pressed: to allow passage of compressed air (arrow 80). The signal 81 swings the distributors 67 and 68 and the inflatable cushion or air chamber is supplied with compressed air. The pressure in the chamber 50 balances the weight of the roll of cloth which rises according to the arrow 53 (FIG. 15) to come to bear under the fixed stops 52. The harness and the shaft are attached by a peg as described previously. The cable is kept constantly taut owing to the tensioning device 62 fixed near to the anchor point of its outer end to the frame (FIG. 15). During this operation the upper chamber of the jack 59 remains connected to the exhaust through the distributor 71.

Figure 17:
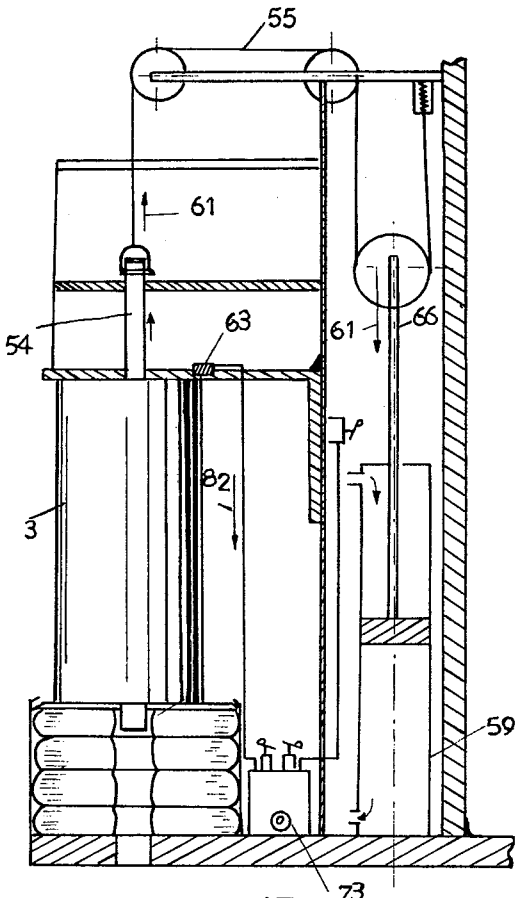
Figure 16:
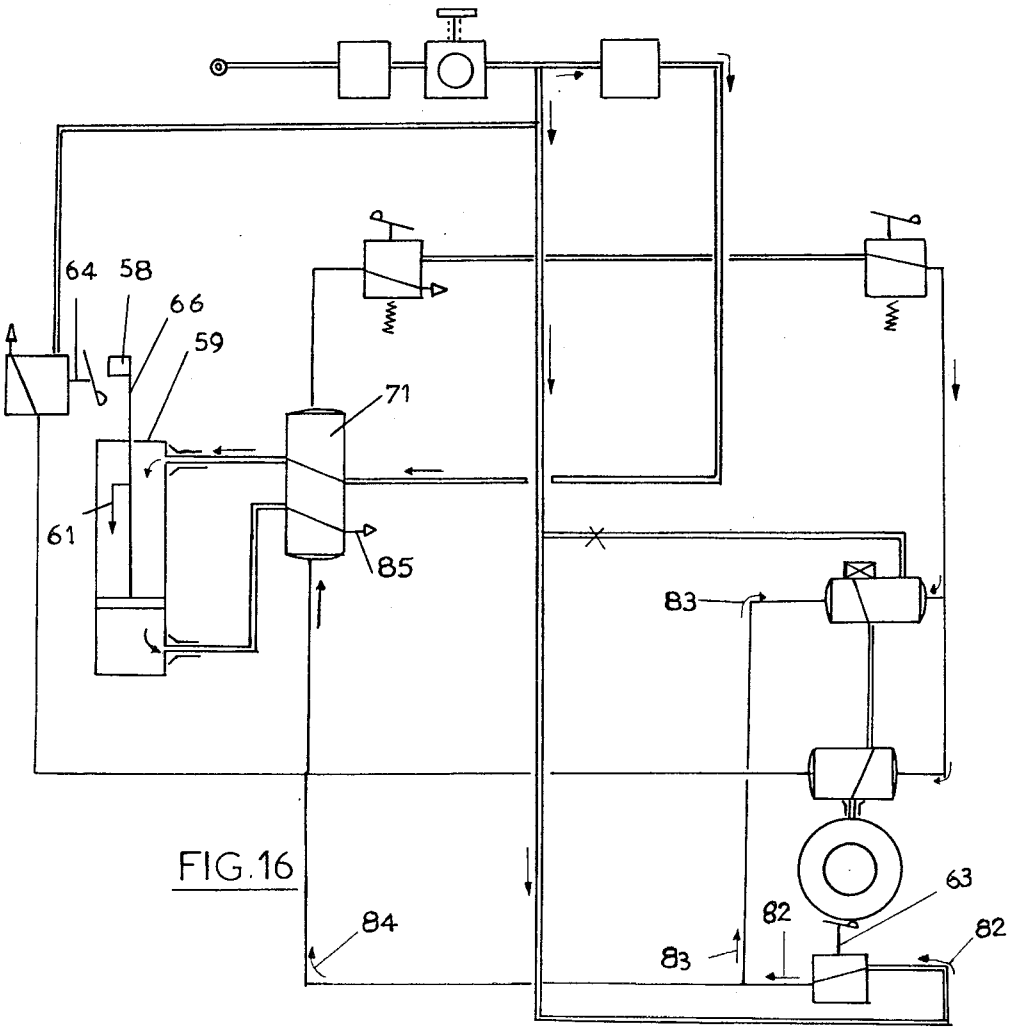

When the roll 3 is pressed against the stop 52 it operates the limit rocker 63 FIGS. 16 and 17 illustrate the compressed air distribution following the arrow 82 can pass and a signal is sent:

(a) in one direction following the arrow 83 towards the distributor 67 (FIG. 14) which swings to the exhaust position. The admission of air to the chamber 50 (FIG. 14) is cut off. However, the exhaust opening of the distributor is closed, so that pressure is maintained in the inflated chamber 50 and (b) in another direction towards the distributor 71 (arrow 84) which swings. The lower chamber is opened to the exhaust 85 and the stem of the jack re-enters (arrow 61).

The re-entry of the jack draws down the pulley 58, and causes the extraction of the shaft 54 (FIG. 17).

Figure 19:
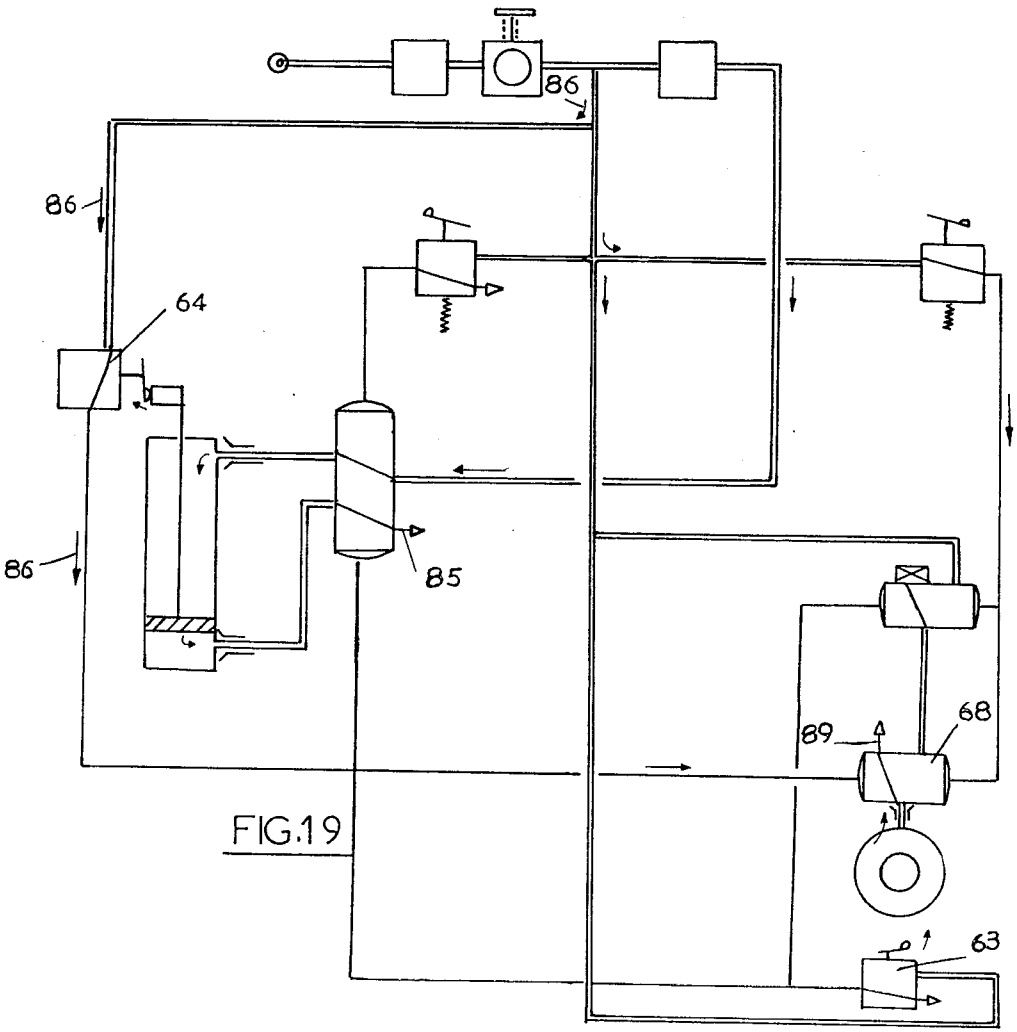
Figure 18:
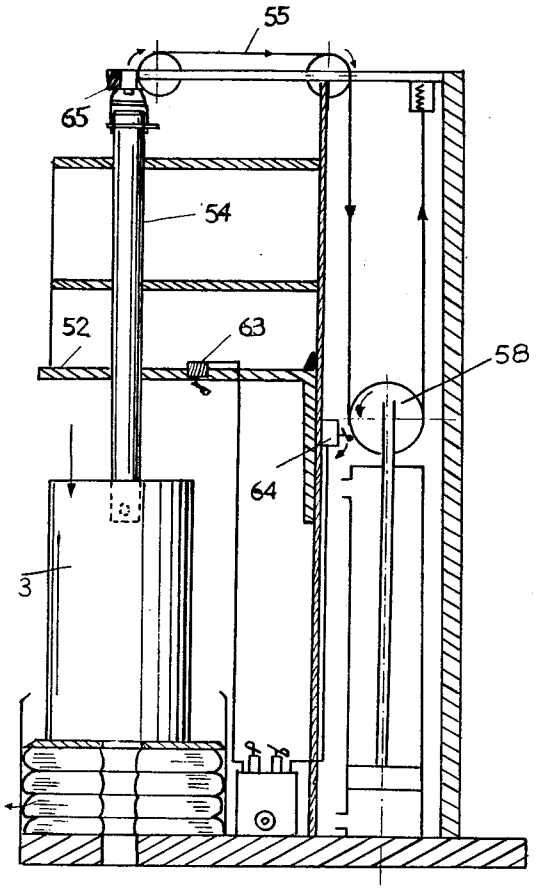

FIGS. 18 and 19 show that, when the jack has re-entered, the pulley 58 operates the limit rocker 64 which sends a signal 86 to the distributor 68: the swing of the valve of this distributor connects the chamber 50 to the exhaust. The roll of cloth re-descends as its support deflects, whilst the shaft 54 remains bearing against the upper support 65 of the frame.

Figure 21:
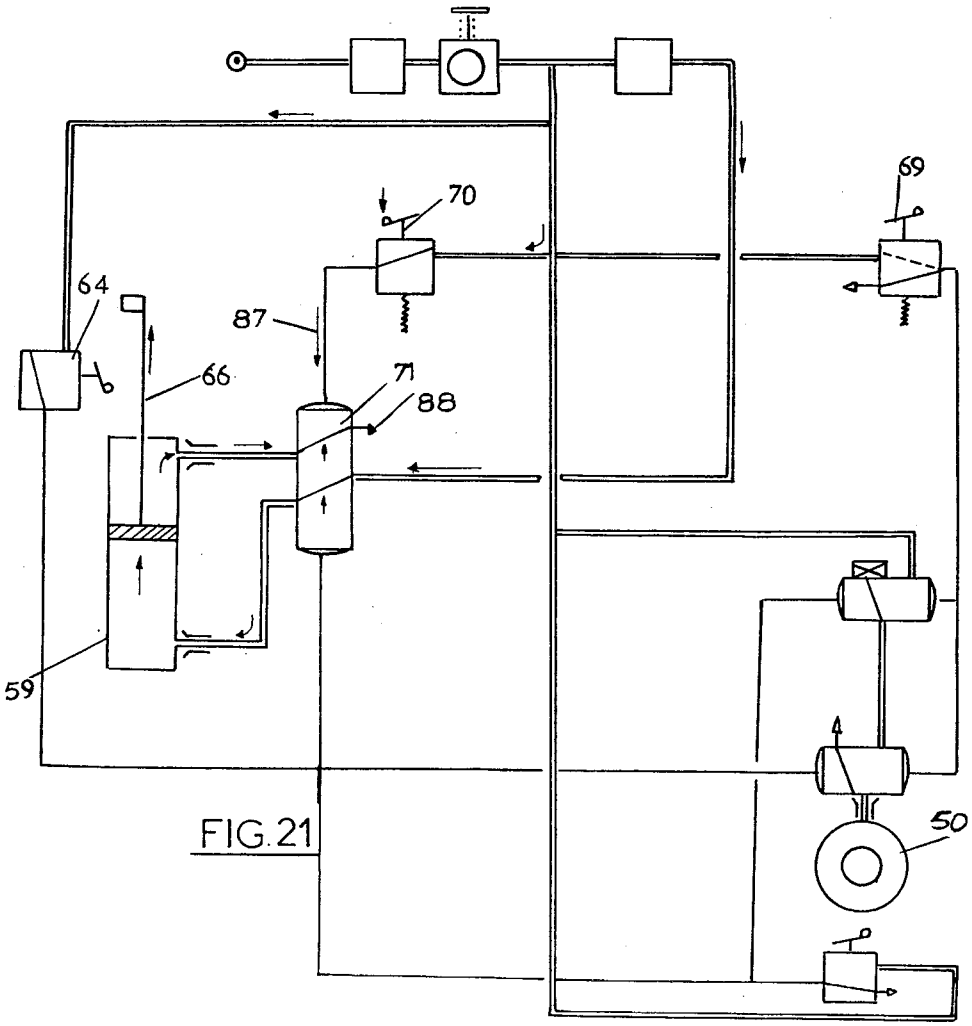
Figure 20:
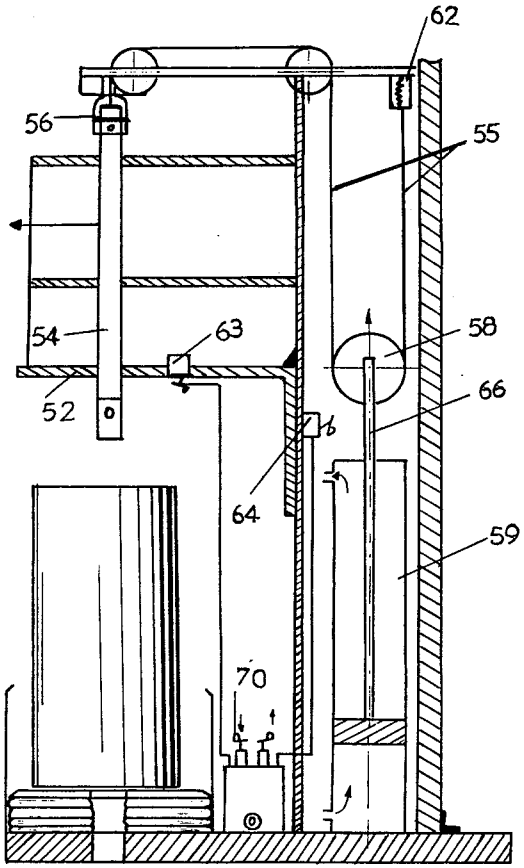

FIGS. 20 and 21 illustrate the rest or starting position for a new extraction cycle is reached by operating the button 70. A signal is sent to the distributor 71 which swings and connects the upper chamber of the jack to the exhaust. The stem 66 extends. The tension on the cable diminishes and the shaft 54 may be detached. (FIGS. 20 and 21).

Figure 22:
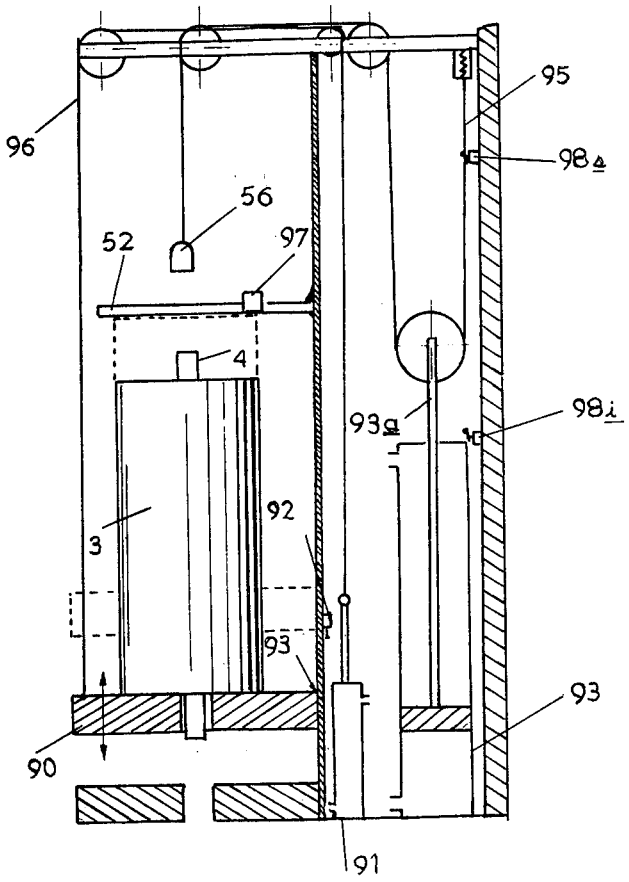
FIG. 22 is a variant of a vertical machine with two double-action jacks.

FIG. 22, illustrates another embodiment for the support cushion. The inflatable support cushion 50 is replaced by a metal plate 90 able to move along the uprights of the frame under the action of an auxiliary double-action jack 91. The pneumatic circuit of this method of manufacture is shown schemmatically in FIG. 23. This embodiment of the vertical model machine presents several advantages:

the mobile plate 90 constitutes a more stable support for the roll of cloth;

the placing, then removing, of the piece of cloth are facilitated;

the successive stages of a cycle of extraction are all brought about pneumatically and controlled from a single button 92.

At the beginning of the operation, the principal extraction jack 93 and the auxiliary positioning jack 91 have their stems extended as shown in FIG. 22. The stem 91*a* acts upon cables 96 suspending the mobile plate 90 guided according to double arrow 94 along the frame. The stem 93*a* operates the extraction cable 95.

Figure 23:
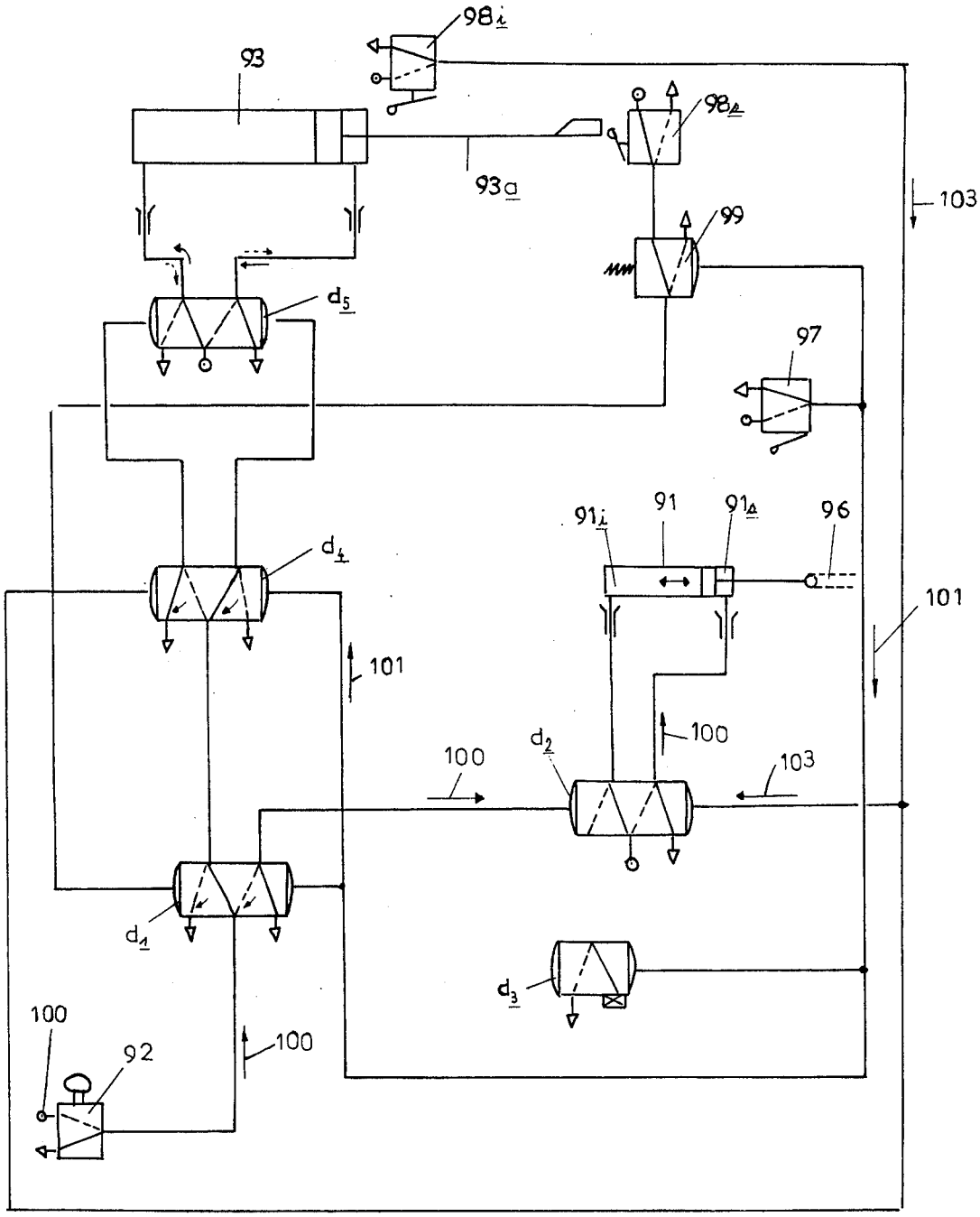
FIG. 23 is a schematic view of the pneumatic circuit of the machine with two jacks.

The components of the pneumatic circuit are initially in the position shown in full lines in FIG. 23. The operation is then as illustrated in FIGS. 22 and 23:

The piece of cloth 3 with its shaft 4 is placed on the plate 90. The control button 92 is pressed. (The chamber 91*i* is connected to the exhaust). The distributors $d_1$, $d_2$ and $d_3$ swing; the chamber $91_s$ is put under pressure and the piston of the jack 91 retracts under the effect of the signal 100. The stem draws the cables 96. The support plate 90 rises until it applies the piece of cloth 3 against the fixed stops 52 (FIG. 22, position shown in broken lines). The limit contacter 97 is then operated and sends a pneumatic power signal 101. The distributors return to their original position. The feed to the auxiliary jack 91 is then cut off, the button 92 likewise returning to the exhaust position.

The harness 56 is attached to the upper end of the shaft 4.

The button 92 is again operated. The distributors $d_1$, $d_4$ and $d_5$, feeding the principal jack 93, swing under the action of the pneumatic control power signals passing through an upper limit contacter $98_s$, and a distributor 99. The stem 93*a* of the extraction jack retracts (the upper chamber is under pressure) and causes the extraction of the shaft 4 by traction of the cable 95.

At the end of its travel, the stem acts on a rocker 98; which allows the passage of a signal 103 to order the removal of the feed of the auxiliary jack. The signal 100 feeds, after the swing of $d_2$ and $d_3$ the lower chamber 91: The stem extends, the plate 90 and the piece of cloth 3 redescend, whilst the signal 101 is cut off (the limit contacter 97 swings).

The piece of cloth 3, removed from its shaft 4, is then taken from the machine.

Another operation of the control button 92 reverses the pneumatic feed of the principal jack 93 of which the stem extends and allows the shaft 4 to redescend; this may then be taken from the machine after having been detached from the harness 56.

It will be seen that the horizontal and vertical models operate in the same way, that is, by applying the roll of cloth against fixed plates, attaching the shaft on which it is rolled to a harness fixed to a taut cable, and finally drawing on this cable with the aid of a pneumatic jack to extract the shaft from the roll mechanically.

The vertical machine proves valuable because of its small floor space, which is particularly interesting for knitting sheds which are often very crowded.

Naturally the preceding constructions have been described only by way of example. The scope of the invention will not be exceeded by modifying the constructional details of the machine's components.

Having described the invention, what is claimed is:

1. A machine for extracting a shaft from a roll of woven or knitted textile cloth, wherein said shaft has at least one end projecting from the cloth rolled thereon, said machine comprising:

a fixed frame;

stop means mounted to said frame;

means for positioning said roll adjacent said stop;

a traction cable having holding means at one end, said holding means adapted to attach said one end of the cable to said projecting end of the shaft;

means for tensioning said traction cable attachable to the opposite free end of said cable; and means for actuating said traction cable interposed said one end and said means for tensioning, whereby when said roll is positioned against said stop and said holding means is attached to said projecting end of the shaft, said actuating means is operative to extract said shaft from said roll of cloth.

2. The machine as claimed in claim 1 wherein said holding means further comprises:

a harness adapted to connect to said one end of said cable, said harness further comprising:

a yoke;

a detachable peg mounted to said yoke and said one end of the shaft;

means for mounting the furcated end of said yoke and detachable peg to said one end of the roll shaft; and means for securing said traction cable to said harness.

3. The machine as claimed in claim 1 wherein said actuating means further comprises a double-acting jack having a free end, said jack being movable to control the displacement of said traction cable.

4. The machine as claimed in claim 2 wherein said actuating means further comprises a double-acting jack having a free end, said jack being movable to control the displacement of said traction cable.

5. The machine as claimed in claim 4 further comprising:

a first fixed guide pulley carried by said frame;

a piston stem communicating with said double-acting jack, said piston stem having a free end external to said double-acting jack;

a mobile pulley carried by said free end of the jack, said mobile pulley being situated on the path of the traction cable interposed said first fixed guide pulley and said opposite end of the traction cable; and means for immobilizing said mobile pulley during extraction of the shaft from the roll, the displacement of the piston stem drawing on the mobile pulley and modifying the run of the traction cable, whereby the position of the mobile pulley determines the position of the extraction yoke.

6. The machine as claimed in claim 5 wherein said stop means further comprises:

a pair of spaced stops mounted to said frame in a spaced relationship, said spacing allowing the passage of said extraction shaft between said stops while holding said roll of cloth axially immobile, said spaced stops being aligned in a transverse vertical plane, said stops further being fixed to a horizontal table defined by said frame, said table having near to one end the transverse horizontal shaft of said first fixed guide pulley cooperating with the extraction cable.

7. The machine as claimed in claim 1 wherein said means for tensioning comprises:

a ramp;

a counterweight slidably mounted to said ramp, said counterweight further being fixed to said opposite free end of said traction cable; and a bearing stop mounted to said ramp, said bearing stop immobilizing said counterweight as said counterweight approaches one end of said ramp.

8. The machine as claimed in claim 5 wherein the double-action jack controlling the displacement of the traction cable is arranged horizontally and longitudinally within said frame in such a way that said mobile pulley attached to said stem acts on the traction cable at a point interposed said first fixed guide pulley and a second fixed guide pulley carried by said frame, said second guide pulley being free to rotate about a transverse horizontal shaft fixed to said frame.

9. The machine as claimed in claim 5 wherein the shaft of the roll of cloth, the axis of the double-action jack, the guide pulleys and the run of the traction cable are in the same vertical longitudinal plane.

10. The machine as claimed in claim 1 further comprising:

a vertical support mounted to said frame;

a pair of spaced stops mounted to said vertical support in spaced relationship, said spacing allowing the passage of said extraction shaft between said stops while holding said roll of cloth axially immobile, said spaced stops being aligned in a transverse horizontal plane; and a pneumatic positioning means mounted to said frame, said positioning means adapted to place said roll of cloth against one side of said pair of horizontally spaced stops.

11. The machine as claimed in claim 5 further comprising:

a tensioning device attached at one end to the upper part of said frame, said opposite end of said tensioning device attached to said opposite free end of said traction cable; said traction cable carried by said mobile pulley attached to said stem of the double-action jack positioned vertically, said traction cable further carried by said first fixed guide pulley carried by said frame so that the harness attached to the one end of said traction cable completes said cable tensioning means by the simple effect of gravity.

12. The machine as claimed in claim 11 further comprising a second fixed guide pulley carried by the upper part of said frame, said second fixed pulley mounted to said frame interposed said mobile pulley and said first fixed guide pulley.

13. The machine as claimed in claim 10 further comprising:

a mobile plate carried by said frame, said mobile plate further supporting said roll of cloth;

an auxiliary double-action jack having a stem linked to said mobile plate, the movement of said auxiliary double-action jack controlling the positioning of said roll of cloth against said fixed stops while said double-action jack extracts said shaft upon which the cloth is rolled.

14. The machine claimed in claim 1 further comprising hydraulic distribution and limit contactors mounted to said frame so that the different stages of a cycle of extraction are controlled from a single push button.

15. The machine as claimed in claim 1 further comprising means for positioning said roll adjacent said stop means and a double-action jack for extracting said shaft.

* * * * *

UNITED STATES PATENT AND TRADEMARK OFFICE

CERTIFICATE OF CORRECTION

PATENT NO. : 4,100,665

DATED : July 18, 1978

INVENTOR(S) : Jean Rourat and Marcel Rourat

It is certified that error appears in the above-identified patent and that said Letters Patent are hereby corrected as shown below:

Column 6, line 14, following the word "sent" delete the colon and insert therefor ----simultaneously;----.

Signed and Sealed this

Sixth Day of February 1979

[SEAL]

*Attest:*

RUTH C. MASON
*Attesting Officer*

DONALD W. BANNER
*Commissioner of Patents and Trademarks*